US009853422B2

(12) United States Patent
Lee et al.

(10) Patent No.: US 9,853,422 B2
(45) Date of Patent: Dec. 26, 2017

(54) SPARK PLUG

(71) Applicant: Hyundai Motor Company, Seoul (KR)

(72) Inventors: Jung Hun Lee, Hwaseong-si (KR); Dong Soo Lee, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 15/269,811

(22) Filed: Sep. 19, 2016

(65) Prior Publication Data

US 2017/0170635 A1 Jun. 15, 2017

(30) Foreign Application Priority Data

Dec. 9, 2015 (KR) ..... 10-2015-0175438

(51) Int. Cl.
*H01T 13/05* (2006.01)
*H01T 13/16* (2006.01)

(52) U.S. Cl.
CPC ..... *H01T 13/05* (2013.01); *H01T 13/16* (2013.01)

(58) Field of Classification Search
CPC ..... H01T 13/05
See application file for complete search history.

(56) References Cited

U.S. PATENT DOCUMENTS

2009/0189504 A1* 7/2009 Malek ..... H01T 13/50 313/143
2012/0212131 A1* 8/2012 Kameda ..... H01T 13/50 315/71

FOREIGN PATENT DOCUMENTS

| | | | |
|---|---|---|---|
| JP | 5-242954 | A | 9/1993 |
| JP | 2005-188340 | A | 7/2005 |
| JP | 2008-535195 | A | 8/2008 |
| JP | 2010-15856 | A | 1/2010 |
| KR | 10-1998-036799 | A | 8/1998 |
| KR | 10-2009-0060813 | A | 6/2009 |

* cited by examiner

*Primary Examiner* — Donald Raleigh
*Assistant Examiner* — Kevin Quarterman
(74) *Attorney, Agent, or Firm* — Morgan, Lewis & Bockius LLP

(57) ABSTRACT

A spark plug may include a center electrode disposed in a center portion of the spark plug, an insulator surrounding the center electrode, and a metal shell surrounding the insulator and having a ground electrode extending downwards from a lower end of the metal shell and an inner surface facing the insulator, the inner surface being concavely shaped to form a shielding space between the concavely shaped portion of the inner surface and the insulator for adjusting a heat range of the spark plug.

7 Claims, 7 Drawing Sheets

SPARK PLUG

CROSS-REFERENCE TO RELATED APPLICATION

The present application claims priority to Korean Patent Application No. 10-2015-0175438, filed Dec. 9, 2015, the entire contents of which is incorporated herein for all purposes by this reference.

BACKGROUND OF THE INVENTION

Field of the Invention

The present invention relates to a spark plug, and more particularly to a spark plug, which is mounted in a combustion chamber of an engine for a vehicle to ignite a fuel-air mixture by generating a spark.

Description of Related Art

In general, a spark plug used in a gasoline engine for a vehicle includes a center electrode disposed in the center portion thereof, an insulator surrounding the center electrode, a metal shell surrounding the insulator, and a ground electrode extending downwards from the lower end of the metal shell. A spark current is generated between the center electrode and the ground electrode, and the spark occurring at this time ignites the compressed fuel-air mixture in a combustion chamber.

As shown in FIG. 6, spark plugs are classified into a hot type, a medium type and a cold type according to the length of a length portion (a portion C), which is exposed to the combustion chamber. A reference numeral 602 denotes an insulator, a reference numeral 603 denotes a metal shell, a reference numeral 604 denotes a hex nut, a reference numeral 605 denotes an insulator tip, and a reference numeral 610 denotes a ground electrode. The classification is determined based on a heat range, which indicates the degree to which the spark plug dissipates heat. The hot type spark plug has a low heat dissipation effect, and the cold type spark plug has a high heat dissipation effect. As known from FIG. 6, because the length portion of the cold type spark plug is relatively short, the cold type spark plug has a decreased heat receiving area and an increased heat dissipating area, and thus the heat source available to the spark plug during combustion is small. In contrast, because the length portion of the hot type spark plug is relatively long, the hot type spark plug has an increased heat receiving area and a decreased heat dissipating area, and thus the heat source available to the spark plug during combustion is large.

In order to optimize combustion in an engine, a spark plug having a heat range suitable for the characteristics of the engine is used. However, in the case of a Turbo-charged Gasoline Direct Injection (T-GDI) engine, which is equipped with a turbo-charger, it is hard to adopt a spark plug having a heat range suitable for the characteristics of the engine.

Generally, in comparison with a Naturally Aspirated (NA) engine, the temperature and pressure of combustion in the T-GDI engine are considerably increased owing to supercharging by the turbo-charger. Such a combustion environment may increase the possibility of pre-ignition, and a knocking phenomenon, attributable to pre-ignition, may abnormally increase the temperature and pressure in the combustion chamber. High combustion pressure and pressure waves in the combustion chamber due to repeated knocking may burn an insulator of the spark plug, and may lead to imperfect combustion and an overheated engine.

For this reason, although a cold type spark plug is not perfectly suitable, it is applied to a T-GDI engine in order to cope with the high combustion pressure and pressure waves when knocking occurs. This is because the cold type spark plug, having a relatively short length portion, can increase the overall intensity of an insulator. However, because the cold type spark plug retains heat poorly and dissipates heat rapidly, the temperature of the spark plug cannot rapidly reach a self-cleaning temperature when the engine is initially started, which may cause problems of misfiring and deteriorated efficiency of cold start operation of the engine.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a spark plug, which protects an insulator and the plug itself from being burned out by high combustion pressure and pressure waves, improves cold start operation of an engine, and prevents misfiring.

In accordance with various aspects of the present invention, a spark plug may include a center electrode disposed in a center portion of the spark plug, an insulator surrounding the center electrode, and a metal shell surrounding the insulator and having a ground electrode extending downwards from a lower end of the metal shell and an inner surface facing the insulator, the inner surface being concavely shaped to form a shielding space between the concavely shaped portion of the inner surface and the insulator for adjusting a heat range of the spark plug.

The shielding space may be located in an intermediate position between a hex nut and an insulator tip.

The inner surface of the metal shell may be concavely shaped to form the shielding space, and the shielding space may have a quadrangular section.

The shielding space may have a rectangular section defined by a height and a base thereof, the height being greater in size than the base.

The inner surface of the metal shell may be concavely shaped to form the shielding space, and the shielding space may have an uneven section including concavely shaped portions and convexly shaped portions alternately arranged on the inner surface of the metal shell at predetermined intervals in an axial direction.

The inner surface of the metal shell may be concavely shaped to form the shielding space, and the shielding space may have a zigzag-shaped section including threaded portions arranged on the inner surface at predetermined intervals in an axial direction.

The inner surface of the metal shell may be concavely shaped to form the shielding space, and a thermal insulating material may be disposed in the shielding space.

An overall shape of the shielding space may be a hollow cylinder.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention (s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
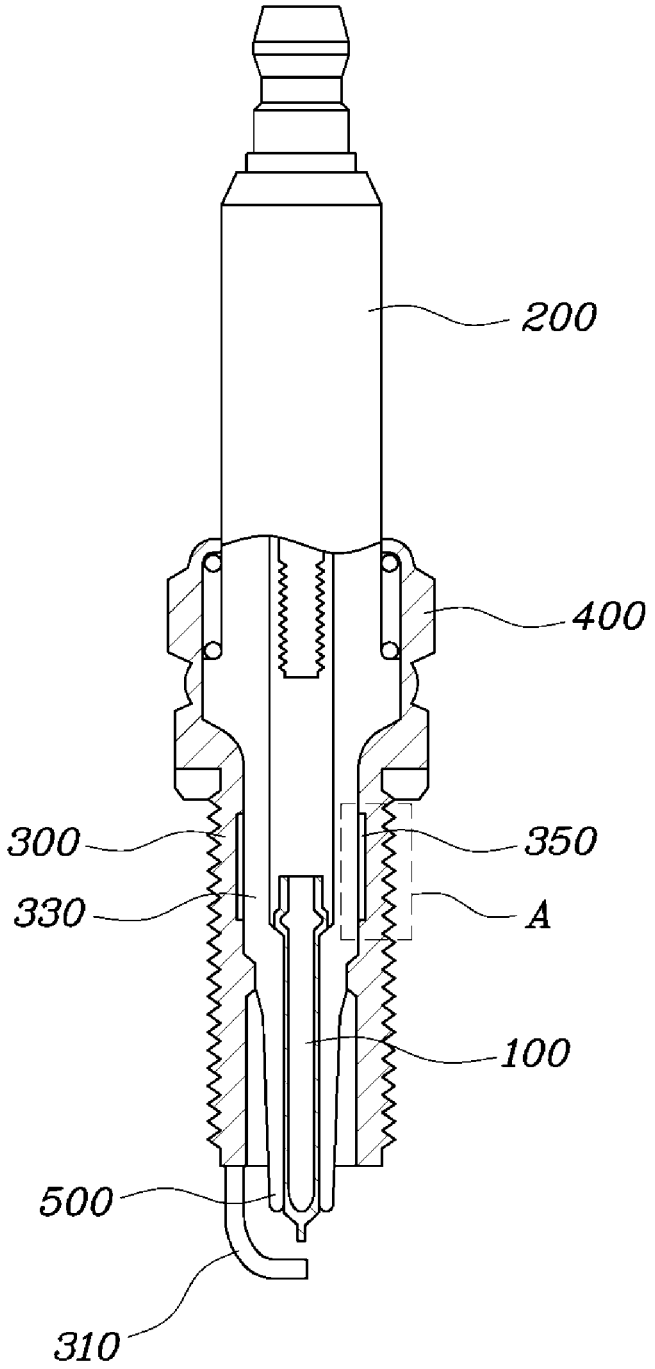
FIG. 1 is a view illustrating an exemplary spark plug according to the present invention.
Figure 6:
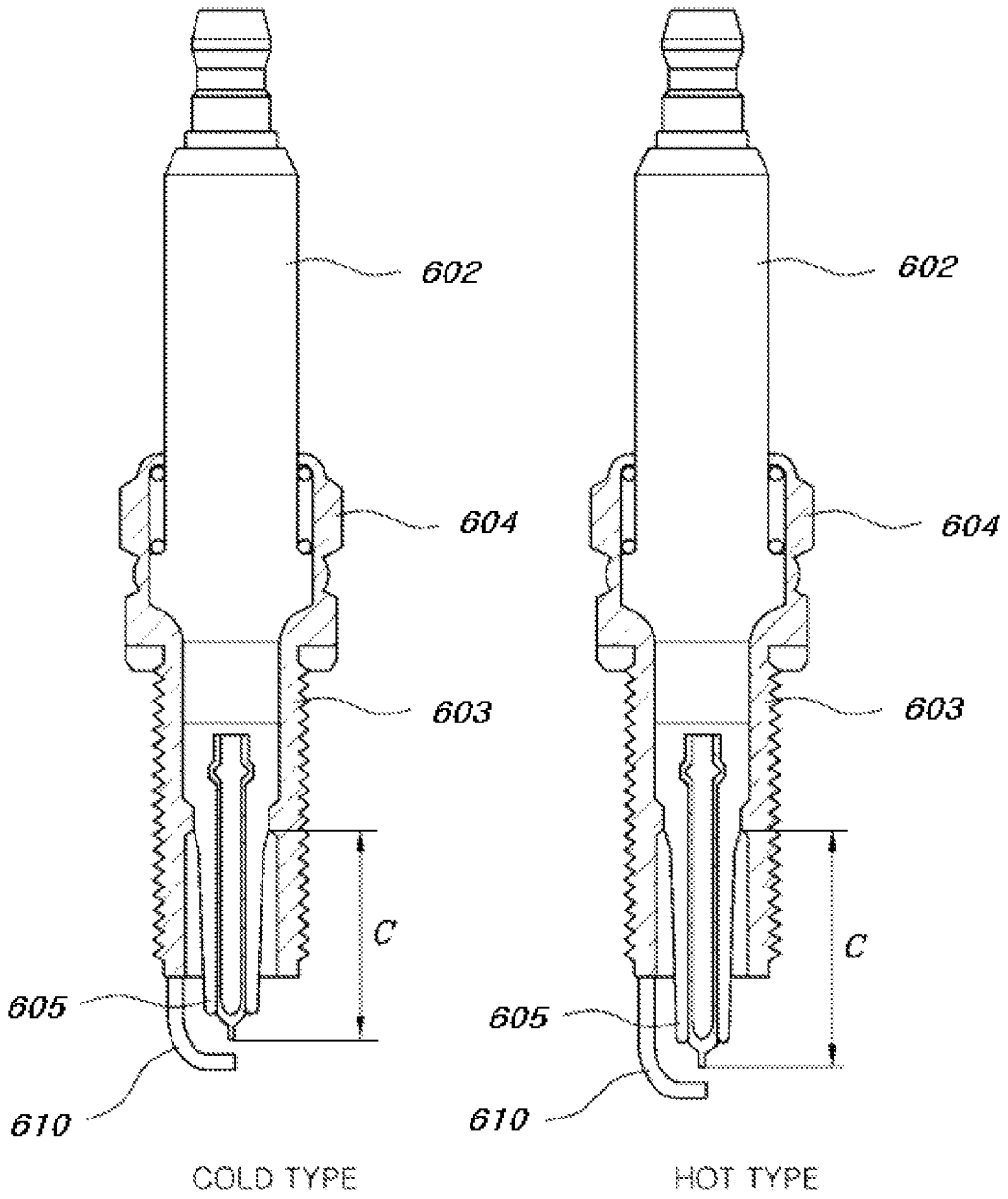
FIG. 6 Related Art
FIG. 6 is a view illustrating typical spark plugs classified based on a heat range according to the related art.
Figure 7:
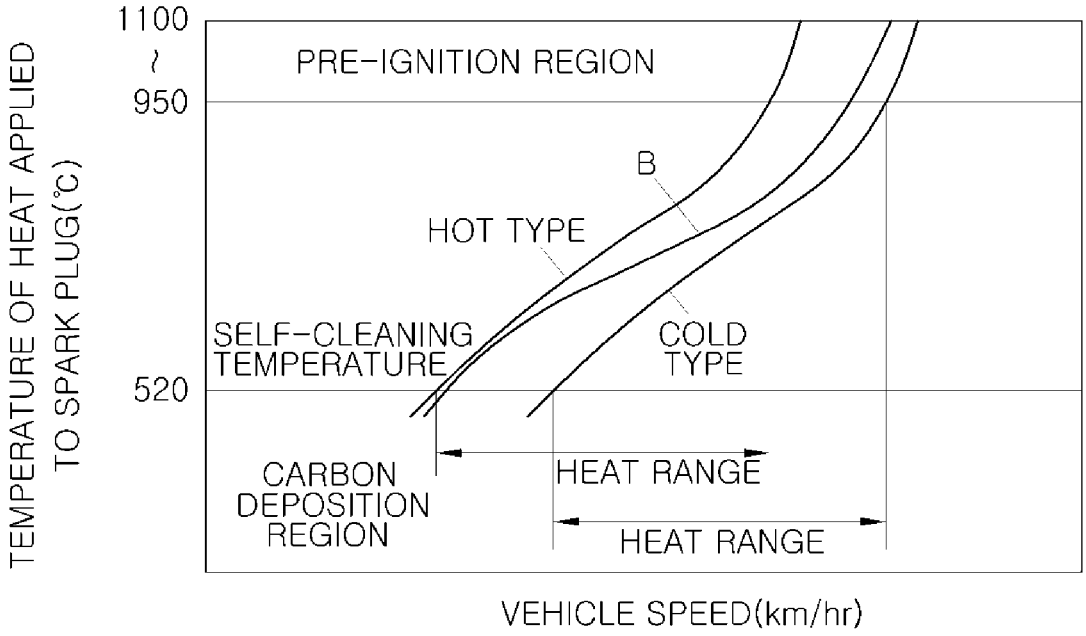
FIG. 7 is a graph illustrating the temperature of heat applied to an exemplary spark plug depending on the vehicle speed.

FIG. 1 is a view illustrating a spark plug according to various embodiments of the present invention, and FIGS. 2 through 5 are views respectively illustrating spark plugs according to various embodiments of the present invention. FIG. 6 is a view illustrating typical spark plugs classified based on a heat range, and FIG. 7 is a graph illustrating the temperature of heat applied to a spark plug depending on the vehicle speed.

A spark plug according to various embodiments of the present invention includes a center electrode 100 disposed in a center portion thereof, an insulator 200 surrounding the center electrode 100, and a metal shell 300 surrounding the insulator 200 and having a ground electrode 310 extending downwards from the lower end of the metal shell and an inner surface 330 facing the insulator 200, a portion of the inner surface 330 of the metal shell 300 being concavely shaped to form a shielding space 350 between the concave portion of the inner surface 330 and the insulator 200 so as to adjust a heat range.

In the specification, a spark plug, which is applied to a T-GDI engine equipped with a turbo-charger, is illustrated and will now be described as an example. As shown in FIG. 6, spark plugs are typically classified into a hot type and a cold type according to the length of a length portion (a portion C), which is exposed to a combustion chamber. Although a cold type spark plug is not perfectly suitable (Max. 750~800° C.) for a T-GDI engine with a turbo-charger, it is applied to a T-GDI engine because it can cope with the high combustion pressure and pressure waves that occur when pre-ignition occurs. Such a cold type spark plug can cope with pre-ignition, but has problems of misfiring and deteriorated efficiency of cold start operation.

Therefore, in various embodiments of the present invention, a way of reducing the heat dissipation of a cold type spark plug is disclosed to solve the above problems of misfiring and deteriorated efficiency of cold start operation. The above-described shielding space 350 is located in an intermediate position between a hex nut 400 and an insulator tip 500, and the heat range can be selectively adjusted by the shielding space 350, thereby solving the above problems even though a cold type spark plug is used.

Hereinafter, the shielding space 350 will be explained in detail with reference to FIGS. 2 through 5. The important factor of the shielding space 350 is the ratio of volume to surface area, and the shape thereof may be variously changed according to the design or environment.

Figure 2:
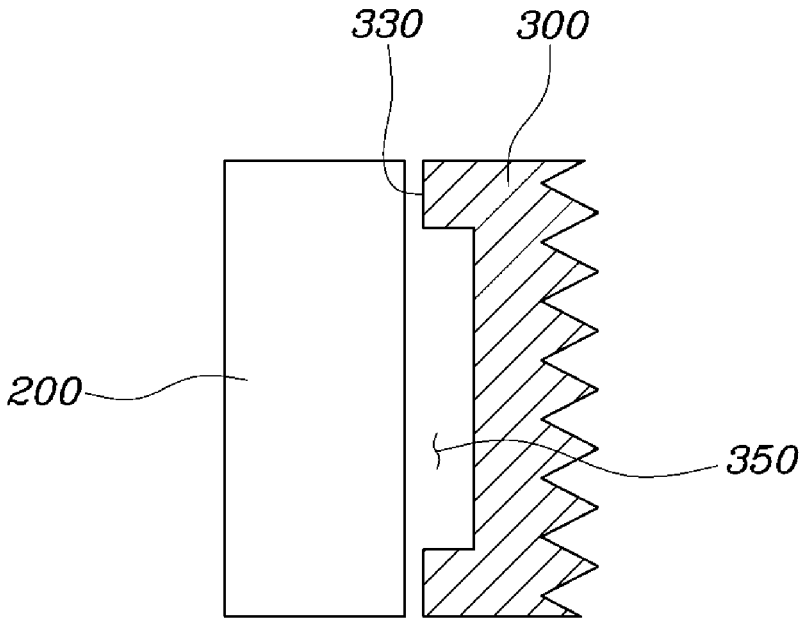
FIGS. 2, 3, 4, and 5 are views illustrating exemplary spark plugs according to the present invention.

FIG. 2 is a view illustrating a structure in which the shielding space 350 is formed between the insulator 200 and the metal shell 300 in such a way that the volume of the shielding space 350 is maximized. A portion of the inner surface 330 of the metal shell 300 is concavely shaped to form the shielding space 350. The shielding space 350 may have a quadrangular section. In some embodiments, the shielding space 350 may have a rectangular section, defined by a height and a base thereof, in which the height is greater in size than the base. Therefore, the overall shape of the shielding space 350 may be a hollow cylindrical shape.

As described above, the inner surface 330 of the metal shell 300 that faces the insulator 200 is concavely shaped to form an air layer between the insulator 200 and the metal shell 300, thereby increasing thermal resistance about 1,000 times as much as that in the conventional art. As a result, the heat dissipation performance of the cold type spark plug is decreased, carbon deposition is prevented, and misfiring is also prevented at the time of cold start of a T-GDI engine equipped with a turbo-charger.

Figure 3:
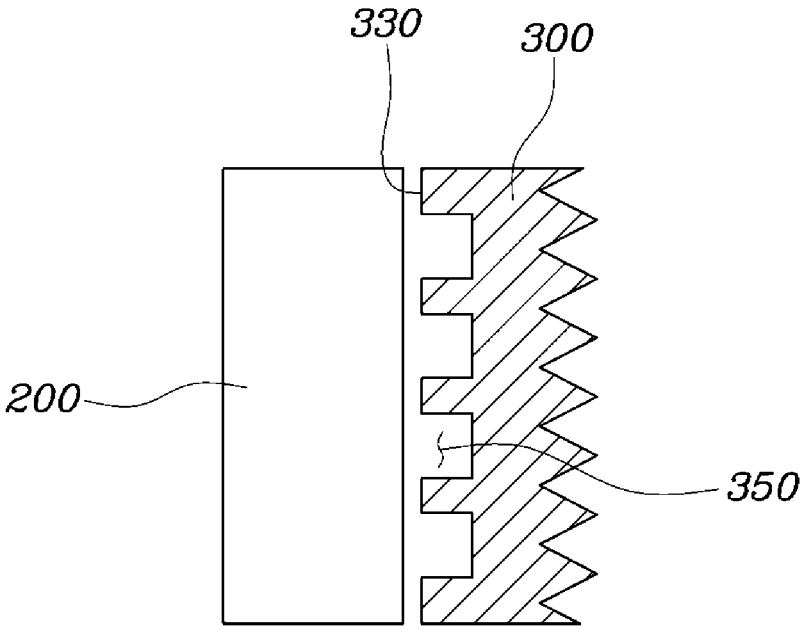

FIG. 3 is a view illustrating a structure in which the shielding space 350 is formed between the insulator 200 and the metal shell 300 in such a way that the volume of the shielding space 350 can be adjusted. A portion of the inner surface 330 of the metal shell 300 is concavely shaped to form the shielding space 350. At this time, the shielding space 350 may have an uneven section including concave portions and convex portions alternately arranged on the inner surface 330 at a predetermined interval in an axial direction. Therefore, by varying the number of concave and convex portions of the shielding space 350, the number and volume ratio of the shielding space 350 can be adjusted so that a spark plug having a heat range suitable for the type of engine can be applied. The overall shape of the shielding space 350 is a hollow cylindrical shape like FIG. 2, and further has an uneven lateral surface including the concave and convex portions. As a result, the ratio of volume to surface area of the shielding space 350 can be adjusted.

Figure 4:
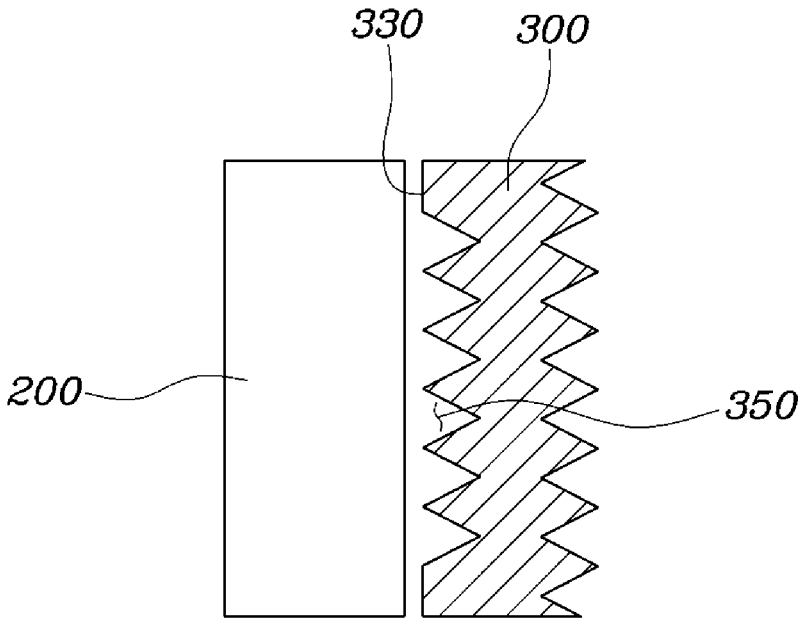

FIG. 4 is a view illustrating a structure in which the shielding space 350 is formed between the insulator 200 and the metal shell 300 in such a way that the volume of the shielding space 350 can be adjusted in consideration of costs and productivity. A portion of the inner surface 330 of the metal shell 300 is concavely shaped to form the shielding space 350. The shielding space 350 may have a zigzag-shaped section including threaded portions arranged on the inner surface 330 at a predetermined interval in an axial direction. The threaded portions formed on the inner surface 330 of the metal shell 300 have the same effect as the concave and convex portions of the shielding space 350 depicted in FIG. 3. Further, since the threaded portions formed on the inner surface 330 of the metal shell 300 have the same shape as the threaded portions formed on the outer surface of the metal shell 300, manufacturing convenience is improved, manufacturing costs are reduced, and productivity is increased.

Figure 5:
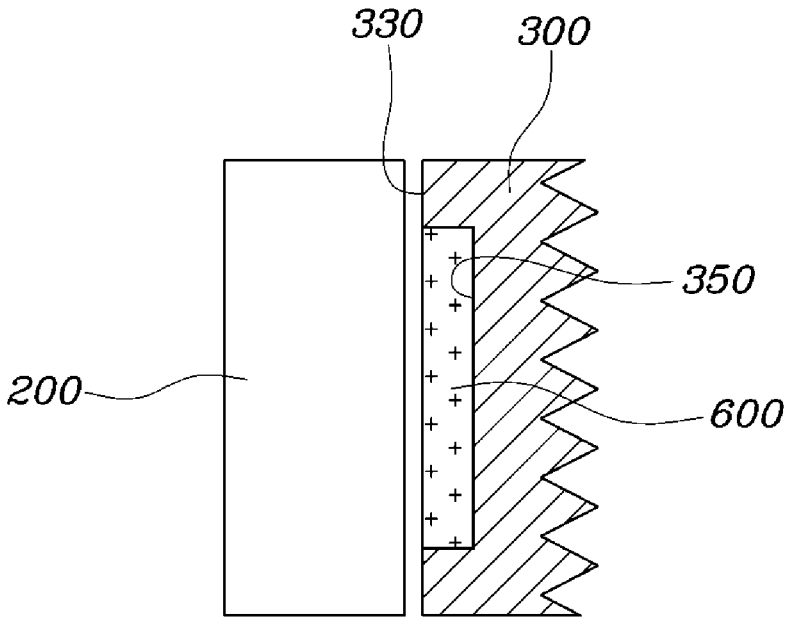

FIG. 5 is a view illustrating a structure in which the shielding space 350 is formed between the insulator 200 and the metal shell 300 and a thermal insulating material 600 is disposed in the shielding space 350. A portion of the inner surface 330 of the metal shell 300 is concavely shaped to form the shielding space 350. Accordingly, the thermal insulating material 600 may be disposed in the shielding space 350. The shielding space 350 may have a rectangular section like FIG. 2, but the sectional shape may be varied according to the design or environment. In the case where the thermal insulating material 600 is disposed in the shielding space 350, as shown in FIG. 5, the shielding effect may be maximized. Accordingly, even when a spark plug is applied to an engine having unfavorable ignition conditions, such as a T-GDI engine equipped with a low-pressure EGR (LP EGR) system and a turbo-charger, cold start operation may be improved, and misfiring may be prevented.

As is apparent from the above description, in order to solve the problems with the conventional art whereby cold start operation is deteriorated and misfiring occurs when a cold type spark plug having a short length portion for reinforcing an insulator is used, various aspects of the present invention provides a spark plug, which can reinforce an insulator by decreasing the length of a length portion and furthermore, can adjust the heat dissipation performance using a shielding space, thereby selectively adjusting the heat range according to the type of engine.

As shown in FIG. 7, a typical spark plug has operational characteristics such that the temperature of the spark plug must rapidly reach a self-cleaning temperature at a low vehicle speed, and must be lower than a pre-ignition temperature at a high vehicle speed. In various embodiments of the present invention, by forming a shielding space between an insulator and a metal shell, a spark plug has the operational characteristics indicated by line B in FIG. 7, whereby, even when a cold type spark plug for reinforcing the intensity of an insulator is used, heat dissipation performance is decreased, ignition stability at the time of initial starting and in a low load region is increased, and misfiring is prevented.

Further, since the heat range of the spark plug can be selectively adjusted, a spark plug satisfying a heat range suitable for the type of engine can be used, thereby increasing usability. The time taken to reach a self-cleaning temperature is reduced upon initial startup by decreasing heat dissipation using a shielding space formed between an insulator and a metal shell. After the temperature of the spark plug reaches a predetermined temperature, the density in the shielding space is decreased, and thus the heat dissipation performance is enhanced, thereby increasing a heat range. Further, since a spark plug having an optimal specification for the type of engine can be manufactured merely by changing a metal shell, without changing an insulator, manufacturing costs may be reduced, and it is easy to respond to new engine developments.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A spark plug comprising:

a center electrode disposed in a center portion of the spark plug;

an insulator surrounding the center electrode; and a metal shell surrounding the insulator and having:

a ground electrode extending downwards from a lower end of the metal shell; and an inner surface facing the insulator, wherein the inner surface is concavely shaped to form a shielding space between the concavely shaped portion of the inner surface and the insulator for adjusting a heat range of the spark plug, wherein the inner surface of the metal shell is concave to form the shielding space, the inner surface having an uneven section including concave portions and convex portions alternately arranged on the inner surface at a predetermined interval in an axial direction.

2. The spark plug according to claim 1, wherein the shielding space is located in an intermediate position between a hex nut enclosing the insulator and an insulator tip of the insulator.

3. The spark plug according to claim 1, wherein the inner surface of the metal shell is concavely shaped to form the shielding space in the inner surface, and the shielding space has a quadrangular section.

4. The spark plug according to claim 1, wherein the shielding space has a rectangular section defined by a height and a base thereof, the height being greater in size than the base.

5. A spark plug comprising:

a center electrode disposed in a center portion thereof;

an insulator surrounding the center electrode; and a metal shell surrounding the insulator and having a ground electrode extending downwards from a lower end of the metal shell and an inner surface facing the insulator, the inner surface being concave to form a shielding space between the concave portion of the inner surface and the insulator so as to adjust a heat range, wherein the inner surface of the metal shell is concavely shaped to form the shielding space therein; and wherein the inner surface of the metal shell has a zigzag-shaped section including threaded portions formed on the inner surface at predetermined intervals in an axial direction of the spark plug.

6. The spark plug according to claim 1, wherein:

the inner surface of the metal shell is concavely shaped to form the shielding space therein; and a thermal insulating material is disposed in the shielding space.

7. The spark plug according to claim 1, wherein an overall shape of the shielding space is a hollow cylinder.

* * * * *